US006036276A

United States Patent [19]

Faw et al.

[11] Patent Number: 6,036,276

[45] Date of Patent: Mar. 14, 2000

[54] CONVEYOR LIFT AND SERVICE SHOE ASSEMBLY AND METHOD OF MOVING

[75] Inventors: Jonathan G. Faw, Bluefield, W. Va.; Ronald W. Keen, Blacksburg, Va.

[73] Assignee: Eimco LLC, Bluefield, W. Va.

[21] Appl. No.: 08/879,437

[22] Filed: Jun. 20, 1997

[51] Int. Cl.[7] ..... E21C 35/06

[52] U.S. Cl. ..... 299/64

[58] Field of Search ..... 299/39.2, 64; 198/302, 198/313, 861.2

[56] References Cited

U.S. PATENT DOCUMENTS

| | | | |
|---|---|---|---|
| 1,710,129 | 4/1929 | Whitnall | 198/302 |
| 2,268,692 | 1/1942 | Bisset | 198/346 |
| 2,483,650 | 10/1949 | Lee | 180/438 |
| 3,095,080 | 6/1963 | Wagner | 198/302 |
| 3,100,563 | 8/1963 | Biedess | 198/861.2 |
| 3,297,146 | 1/1967 | Munger et al. | 198/861.2 |
| 3,468,408 | 9/1969 | Hammond et al. | 198/835 |
| 3,499,684 | 3/1970 | McCracken | 299/64 |
| 3,774,969 | 11/1973 | LeBegue | 299/76 |
| 3,826,353 | 7/1974 | Greasley | 198/313 |
| 3,865,197 | 2/1975 | McCormick | 173/189 |
| 3,972,429 | 8/1976 | Sigott et al. | 299/64 X |
| 4,088,371 | 5/1978 | LeBegue et al. | 299/76 |
| 4,281,879 | 8/1981 | LeBegue et al. | 299/64 |
| 4,784,439 | 11/1988 | Wrulich et al. | 299/64 X |
| 4,966,417 | 10/1990 | Zitz et al. | 299/64 X |

*Primary Examiner*—William Neuder
*Assistant Examiner*—John Kreck
*Attorney, Agent, or Firm*—Price & Adams

[57] ABSTRACT

A longitudinally extending conveyor discharge section is connected for horizontal and vertical pivotal movement on a frame of a mining machine. A pair of service shoes is connected at one end to the machine frame below the conveyor support frame for pivotal movement into and out of contact with the mine floor. A pair of double acting piston cylinder assemblies is connected at opposite ends to the conveyor discharge section and the service shoes. The conveyor discharge section and the service shoes are removably pinned to the machine frame. The pins for the conveyor discharge section are removed when it is desired to elevate the conveyor by actuation of the cylinder assemblies in a first mode. To perform maintenance operations on the mining machines, the machine frame is elevated by lowering the service shoes to engage the mine floor. The conveyor is lowered and pinned to the frame. The service shoes are then released from their pinned connection to the frame to actuate the cylinder assemblies in a second mode to lower the shoes into contact with the mine floor and elevate the end of the machine frame. With this arrangement a single set of piston cylinder assemblies located at the rearward end of the mining machine frame control movement of both the conveyor discharge section and the service shoes.

20 Claims, 9 Drawing Sheets

CONVEYOR LIFT AND SERVICE SHOE ASSEMBLY AND METHOD OF MOVING

BACKGROUND OF THE INVENTION

1. Field of the Invention

This invention relates to a conveyor lift and service assembly for a mining machine and, more particularly, to a single actuator for lifting both the conveyor to an elevated position and lowering a service shoe into contact with the ground.

2. Description of the Prior Art

Continuous mining machines, as illustrated in U.S. Pat. No. 3,774,969, are used in underground mining operations to continuously dislodge solid material from the working face of a mine. A boom member extends forwardly from an elongated frame of the mining machine that is propelled through the mine on endless crawler tracks. The boom member is pivotally connected to the machine frame and rotatably supports a cutter drum assembly having peripherally extending cutter elements. The cutter drum extends transversely to the longitudinal axis of the machine frame. Upon rotation of the cutting elements solid material is dislodged from the mine face.

The dislodged material is moved rearwardly of the cutter drum assembly by a gathering device onto a receiving end of a conveyor mechanism that extends longitudinally on the machine frame. The conveyor mechanism includes a discharge end portion that is supported by a conveyor support frame for horizontal and vertical pivotal movement rearwardly of the mining machine. A main conveyor portion extends longitudinally on the machine frame from the gathering device to the conveyor discharge end portion.

The conveyor discharge end portion is pivotally connected to the conveyor support frame for horizontal and vertical pivotal movement. The conveyor discharge end portion is pivotal about a horizontal axis for vertical movement to the required height to transfer the mined material into a haulage vehicle and to adjust to the height of the mine entry. The discharge end portion is also connected to the main conveyor support frame for pivotal movement about a vertical axis for horizontal swinging movement relative to the main conveyor portion. Separate piston cylinder assemblies connected to the conveyor discharge end portion actuate the vertical and horizontal pivotal movement.

The conveyor discharge end portion is maintained in material receiving relation with a material haulage vehicle or another conveyor as the mining machine maneuvers the cutter drum assembly to dislodge solid material from the mine face. By maintaining the discharge end portion in material receiving relation with the haulage vehicle, the mined material is continuously conveyed from the mine face.

It is known to utilize conventional piston cylinder assemblies to actuate vertical and horizontal movement of the discharge conveyor. U.S. Pat. Nos. 3,095,080 and 3,826,353 disclose pivotal discharge conveyor assemblies. These conveyors are pivoted vertically by hydraulic cylinders mounted on the assembly frame.

U.S. Pat. Nos. 1,710,129 and 2,483,650 also disclose movable discharge conveyor assemblies. These conveyors are pivoted vertically by mechanical jacks which may be cranked into place against the ground to elevate the conveyor to the desired height.

It is also known to raise and lower the mining machine frame portion by service jacks or shoes to perform maintenance operations on the machine, such as adjusting the tension on the crawler tracks. Service jacks are also used to stabilize or anchor the mining machine frame on the mine floor.

The service jack or shoe is conventionally connected to the machine frame below the conveyor frame. The service shoe requires a separate piston cylinder assembly for lowering and raising into and out of contact with the mine floor. The piston cylinder assembly moves the shoe into contact with the mine floor with sufficient force to stabilize the position of the mining machine or raise the rear of the mining machine frame to an elevated position above the mine floor to provide access for conducting maintenance operations on the machine. U.S. Pat. Nos. 4,088,371 and 4,281,879 disclose stabilizing jacks of this general arrangement.

With the known stabilizing shoes for continuous mining machines, the shoes are positioned beneath the conveyor support frame at the rearward end portion of the body portion. One end of a piston cylinder is connected to the conveyor support frame and the opposite end or the extensible piston rod is connected to the shoe. One end of the shoe is, in turn, pivotally connected to the lower surface of the conveyor support frame.

A disadvantage with the known conveyor lift and service shoe assemblies is their inefficient layout on the mining machine. One set of piston cylinder assemblies is needed to lift the conveyor and a second set of assemblies is needed to actuate the service shoe. This adds to the cost and maintenance of mining machines because more parts and space are required on the machine to accommodate multiple sets of piston cylinder assemblies.

Therefore, there is a need on a mining machine for a single actuated conveyor lift/service shoe assembly that effectively performs the operations conventionally performed by two independent actuators.

SUMMARY OF THE INVENTION

In accordance with the present invention there is provided a unitary lift and service shoe assembly for a mining machine that includes a body portion having a frame. A lift portion is pivotally connected to the frame for movement between raised and lowered positions. A service shoe pivotally connected to the frame moves into engagement with the ground to raise the body portion to a position elevated above the ground. A dual purpose actuator moves both the lift portion between the raised and lowered positions and moves the service shoe to elevate the machine body portion above the ground. The dual purpose actuator has a first end portion and a second end portion. The first end portion is pivotally connected to the lift portion. The second end portion is pivotally connected to the service shoe.

Further in accordance with the present invention there is provided a unitary conveyor lift and service shoe assembly for a mining machine that includes a body portion. The body portion has a frame. A conveyor portion is pivotally connected to a rearward end of the frame for movement between raised and lowered positions. A service shoe is pivotally connected to the frame for movement into engagement with the ground to elevate the machine body portion above the ground. A piston cylinder assembly moves both the conveyor portion between raised and lowered positions and the service shoe into and out of engagement with the ground. The piston cylinder assembly has a first end portion and a second end portion. The first end portion is pivotally connected to the conveyor portion, and the second end portion is pivotally connected to the service shoe.

Additionally, the present invention is directed to a method for moving a conveyor and a service shoe on a mining machine that includes the steps of pivotally mounting a conveyor portion on rearward end of a mining machine frame for movement between raised and lowered positions. A service shoe is pivotally mounted on the rearward end of the mining machine frame for movement into and out of engagement with a mine floor. A first end portion of a hydraulic cylinder assembly is connected to the conveyor portion. A second end portion of the hydraulic cylinder assembly is connected to the service shoe. The hydraulic cylinder assembly is actuated in a first mode to move the conveyor portion between the raised and lowered positions and in a second mode to move the service shoe into and out of engagement with the mine floor.

Accordingly, a principal object of the present invention is to provide method and apparatus for moving both a conveyor and a service shoe on a mining machine with a single actuator assembly.

This and other objects of the present invention will be more completely disclosed and described in the following specification, accompanying drawings, and appended claims.

DESCRIPTION OF THE PREFERRED EMBODIMENTS

Figure 2:
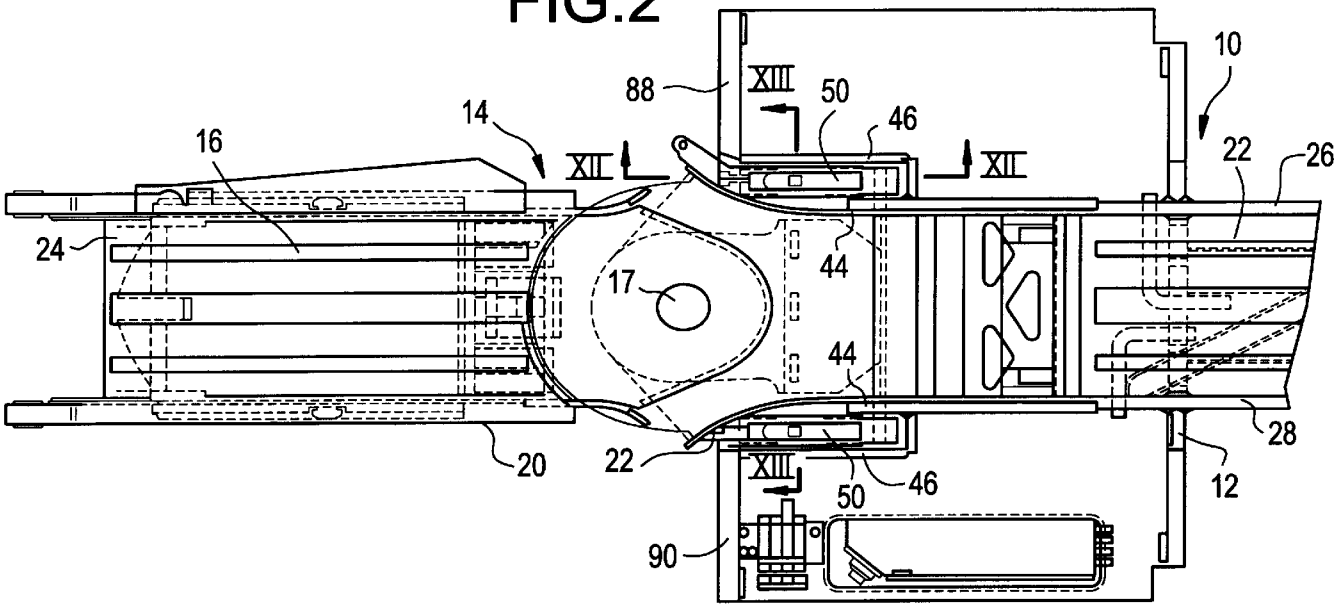
FIG. 2 is a plan view of the discharge conveyor of the mining machine shown in FIG. 1, illustrating a pair of piston cylinder assemblies connected to both the discharge conveyor and the service shoe assembly.
Figure 1:
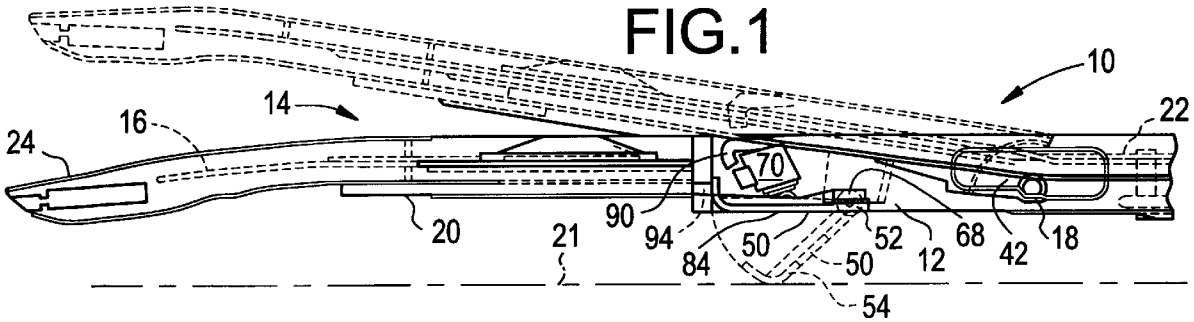
FIG. 1 is a fragmentary view in side elevation of a pivotal discharge conveyor of a mining machine, illustrating an actuator for moving both the conveyor and a service shoe assembly into and out of position.
Figure 3:
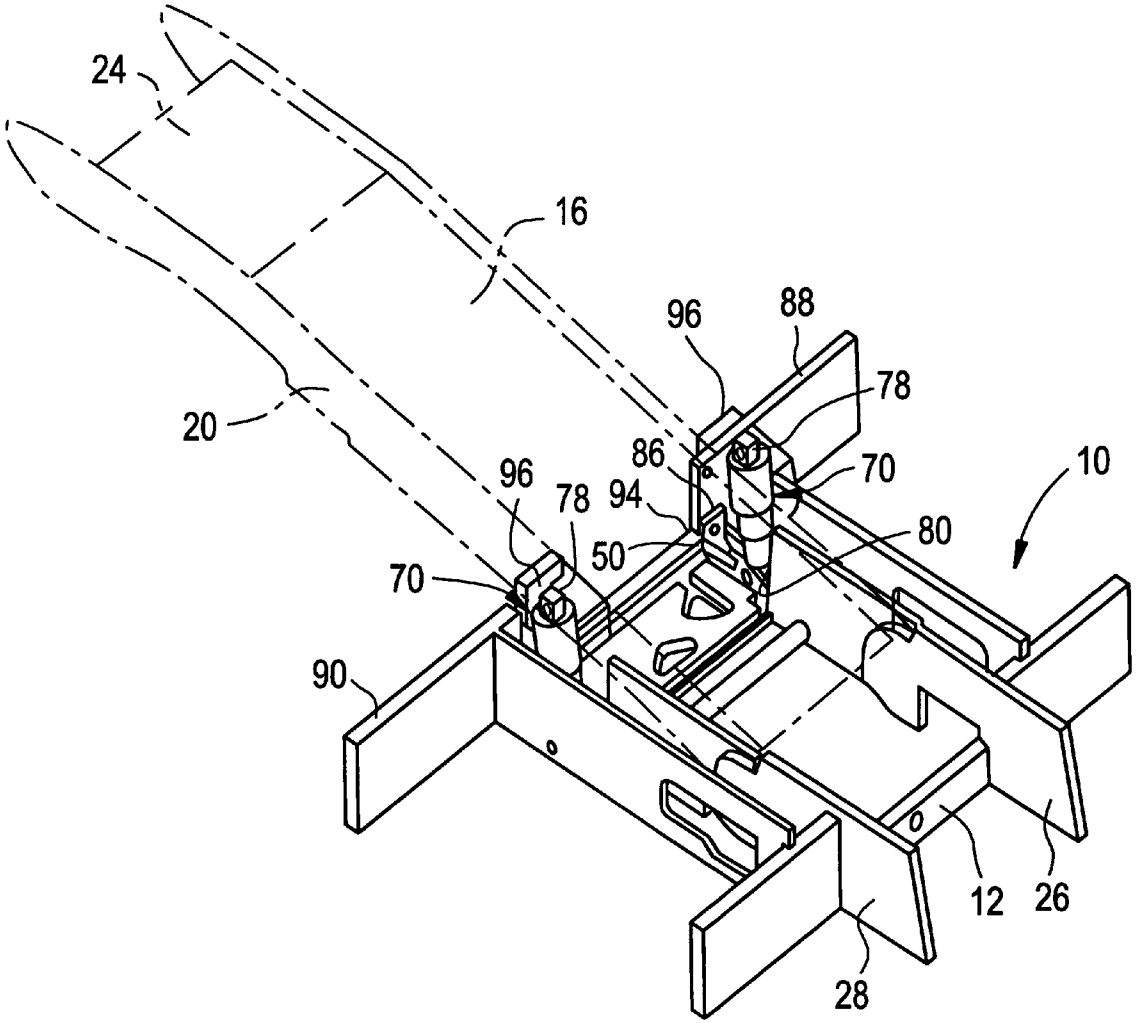
FIG. 3 is an isometric view of the mining machine pivotal discharge conveyor shown in FIG. 1, illustrating the connection of the discharge conveyor and the service shoe assembly to a frame of the mining machine.
Figure 4:
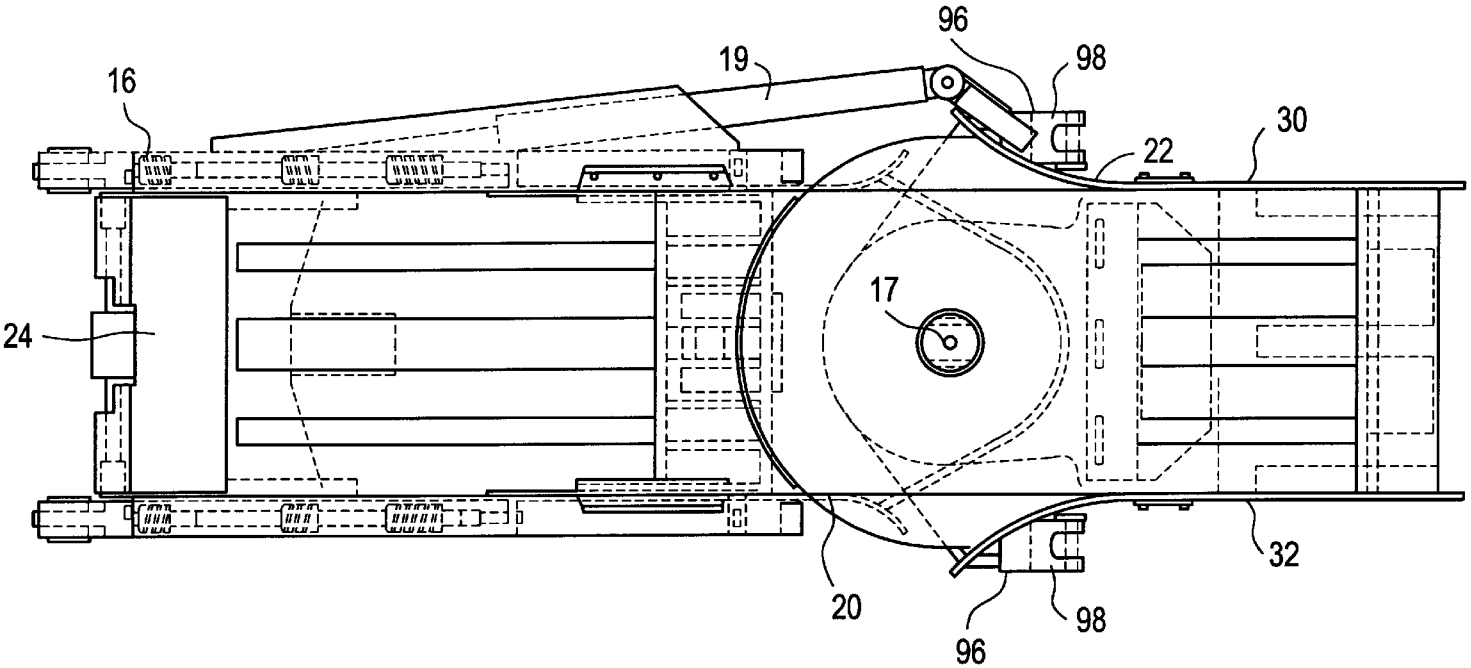
FIG. 4 is a plan view of the pivotal conveyor discharge section.

Referring to the drawings and particularly to FIGS. 1–3, there is illustrated the rearward portion of a continuous mining machine generally designated by the numeral 10 that has a mobile frame portion 12. An endless conveyor mechanism generally designated by the numeral 14 extends longitudinally on the machine frame portion 12 and conveys dislodged material from a gathering device (not shown) at the front of the mining machine 10 to an articulated discharge section 16 of the conveyor 14. The conveyor discharge section 16 includes a conveyor support frame 20 that articulates through a horizontal pivot joint 18 to allow vertical pivotal movement between a lowered position adjacent to a mine floor 21 and a raised position, as illustrated in phantom in FIG. 1. The discharge conveyor frame 20 is also pivotal in a horizontal plane about a vertical pivot joint 17, shown in FIGS. 2 and 4. A piston cylinder assembly 19 (shown in FIG. 4) extending between the discharge conveyor support frame 20 and a main conveyor frame 22 carried by the machine frame portion 12 actuates lateral swinging movement of the conveyor section 16.

The conveyor discharge section 16 is positioned on the conveyor support frame 20 which extends from the main conveyor frame 22 on the machine frame 12, as illustrated in FIGS. 1 and 2. The conveyor support frame 20 extends rearwardly from the mining machine frame portion 12. The conveyor mechanism 14 is carried by the main conveyor frame 22 that extends longitudinally on the mining machine frame 12. The conveyor support frame 20 is connected to machine frame portion 12 for horizontal and vertical pivotal movement.

The conveyor discharge section 16 includes a discharge end portion 24 which is movable with the discharge section 16 through both a vertical arc and a horizontal arc. Mined material is conveyed by the conveyor mechanism 14 on the mining machine frame 12 to the discharge conveyor section 16. From the discharge end portion 24, the mined material is transferred to a haulage vehicle or another conveyor for movement out of the mine.

Figure 5:
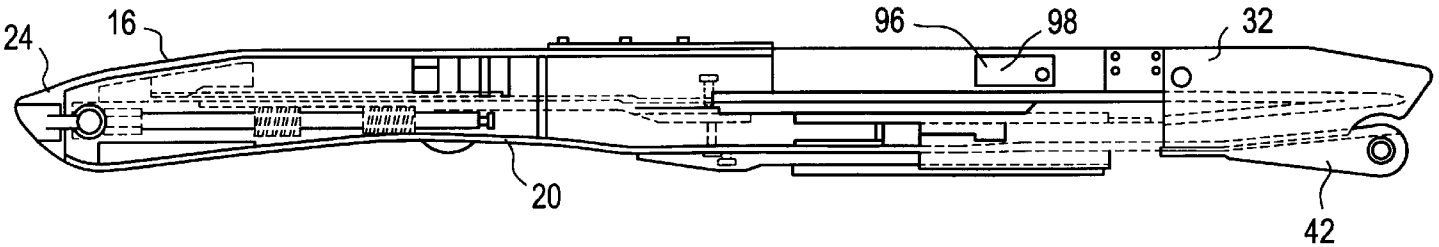
FIG. 5 is a view in side elevation of the conveyor discharge section shown in FIG. 4.
Figure 6:
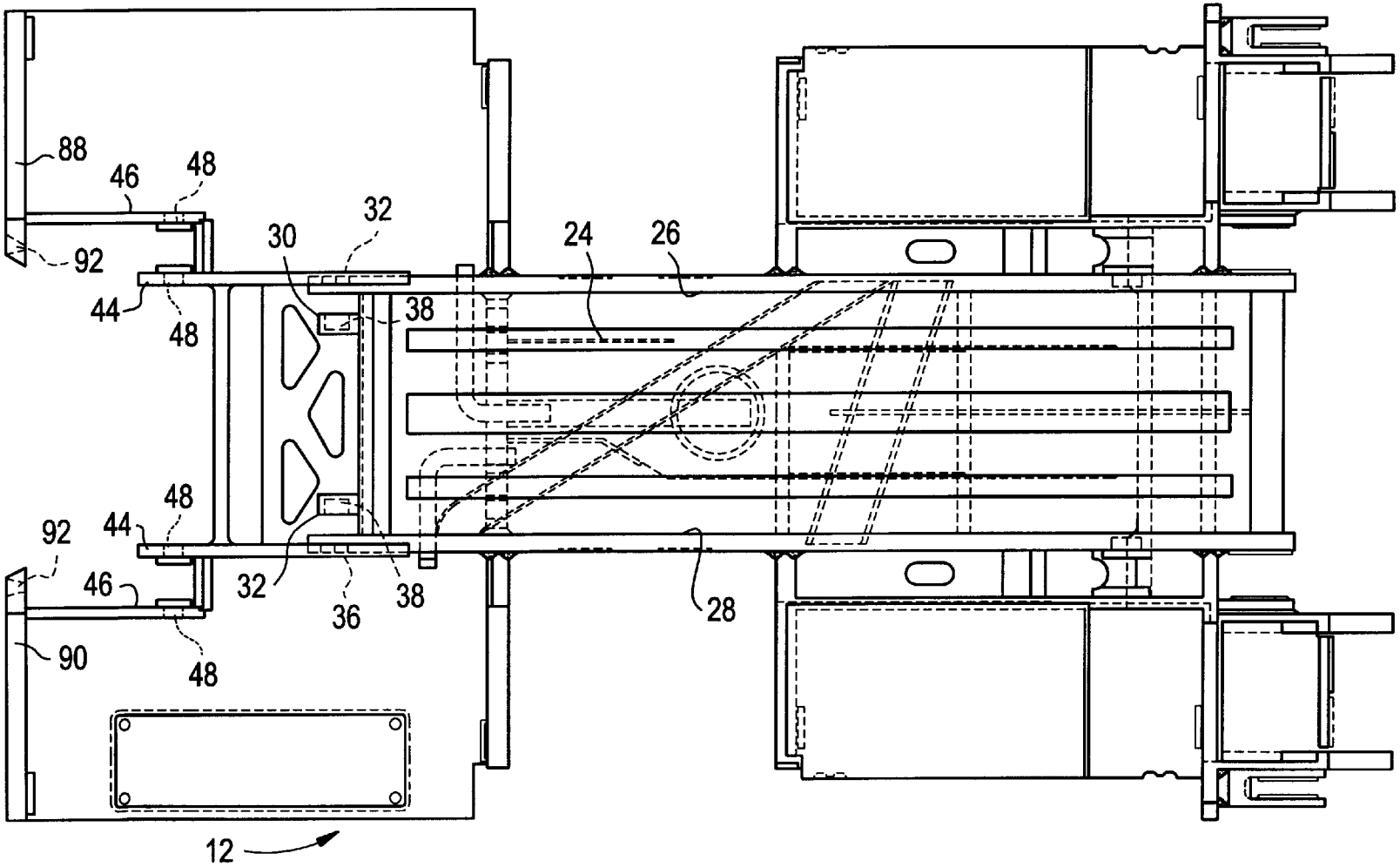
FIG. 6 is a plan view of the mining machine frame for supporting the conveyor discharge section shown in FIGS. 4 and 5 for pivotal movement.
Figure 7:
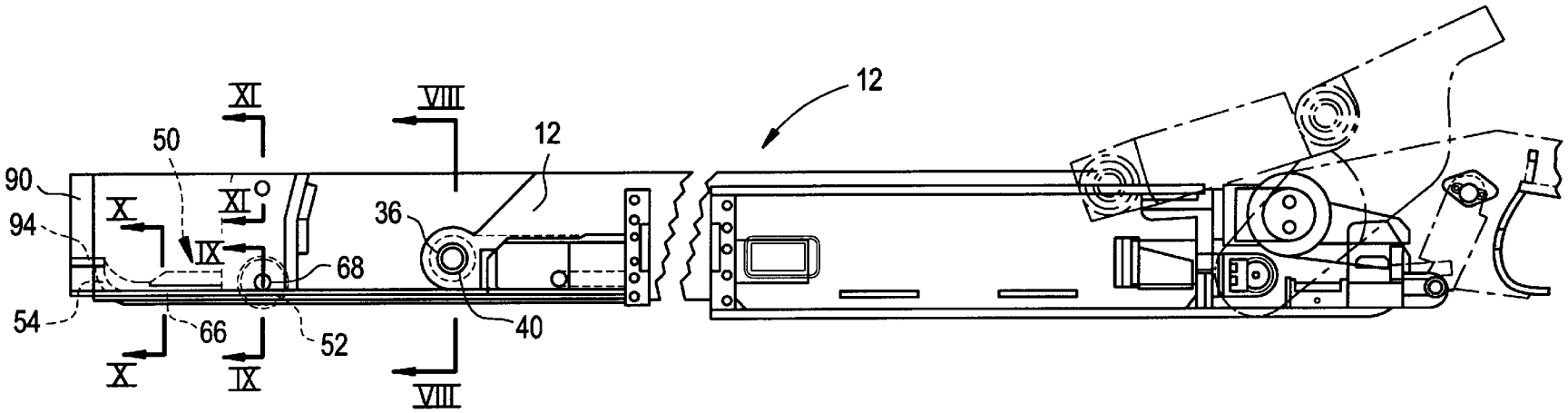
FIG. 7 is a fragmentary view in side elevation of the mining machine frame shown in FIG. 6.
Figure 8:
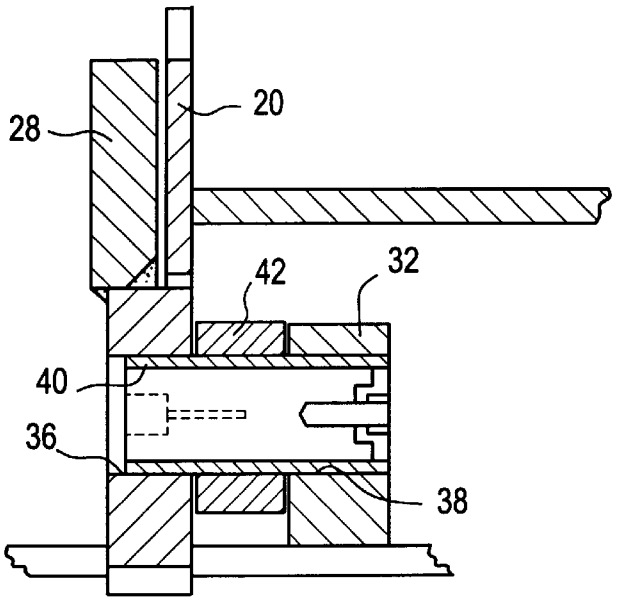
FIG. 8 is a fragmentary sectional view taken along line VIII—VIII of FIG. 7, illustrating the pivotal connection of the conveyor discharge section to the mining machine frame.

As illustrated in FIGS. 6 and 7, the mining machine frame portion 12 includes a pair of longitudinally extending side walls 26 and 28. The pair of side walls 26 and 28 are positioned in spaced parallel relation substantially the width of the conveyor support frame 20. The frame 12, as shown in FIG. 6, also includes a pair of parallel spaced arm members 30 and 32 positioned inboard of the side walls 26 and 28, respectively. The side walls 26 and 28 and arm members 30 and 32 include aligned bores 36 and 38 respectively for receiving pivot pins 40 that connect arms 42 (shown in FIG. 5) extending from the end of the conveyor support frame 20 to the side walls 26 and 28 and arms 30 and 32. This pivot pin connection is shown in detail in FIG. 8.

The above described connection of the conveyor discharge section 16 to the machine frame 12 forms the horizontal pivot point 18 shown in FIG. 1. In this manner, the conveyor discharge section 16 is connected to the machine frame 12 for vertical pivotal movement about the pivot point 18. The pivot point 18 is formed by the above described pivotal connection of the pivot pins 40 in the aligned bores of the conveyor support frame 20 and the mining machine frame 12.

Figure 18:
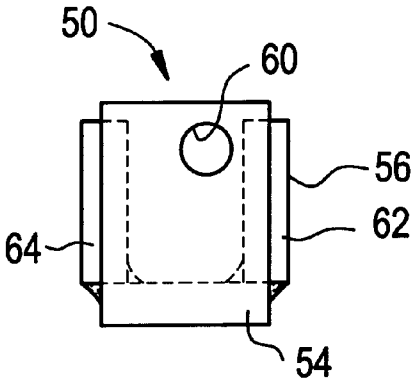
FIG. 18 is an end view of the service shoe shown in FIG. 17.
Figure 16:
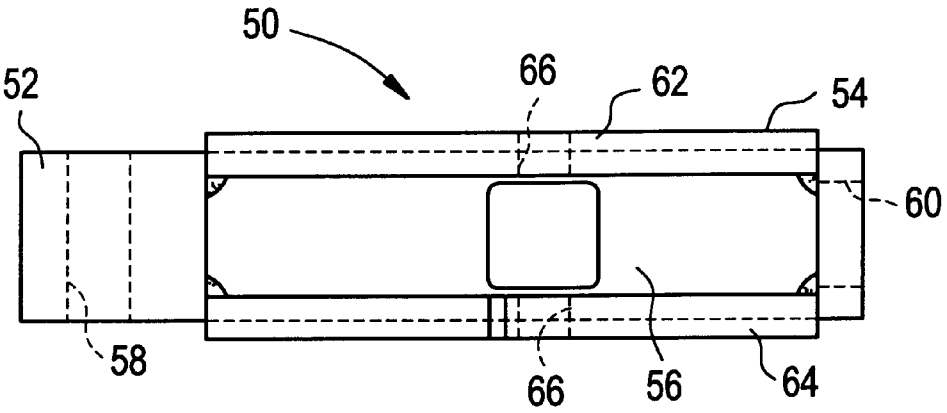
FIG. 16 is a plan view of one of the pair of service shoes.

As illustrated in FIGS. 2, 6, 7 and 9, the rearward end of the machine frame portion 12 includes two pairs of flanges 44 and 46 having longitudinal bores 48 therethrough. The flange pairs 44, 46 are spaced a distance apart to receive a service shoe assembly including a pair of shoes or jacks generally designated by the numeral 50. A representative one of the service shoes 50 is shown in detail in FIGS. 16–18. Each shoe 50 includes a connecting end portion 52 and a ground engaging end portion 54 at opposite ends of an elongated, reinforced body portion 56. The end portion 52 includes a transverse bore 58, and the end portion 54 includes a hole 60 therethrough. The body portion 56 is formed by a pair of longitudinally extending plates 62 and 64 having aligned bores 66 therethrough.

Figure 9:
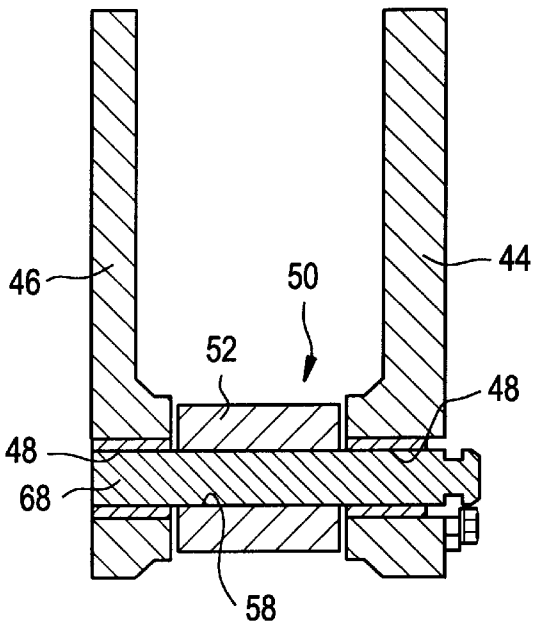
FIG. 9 is a sectional view taken along line IX—IX of FIG. 7, illustrating the pivotal connection of the service shoe to the mining machine frame.

As shown in FIG. 1, the service shoes 50 are pivotally connected to the mining machine frame 12 by pivot pins 68 extending through bores 48 of flanges 44 and 46 aligned with the bores 58 in the end portions 52 of shoes 50. The pivot connection of one shoe 50 to the machine frame 12 is shown in FIG. 9. The pin 68 is securely retained in the aligned bores 48 and 58 with the shoe end portion 52 positioned between flanges 44 and 46. With this arrangement each service shoe assembly 50 is pivotally connected to the frame portion 12 outboard of side walls 26 and 28 for pivotal movement on the frame portion 12 about a horizontal pivotal axis.

It should be understood that while a pair of service shoes 50 is illustrated in the figures, a single unitary shoe 50 pivotally connected to the machine frame 12 below the conveyor support frame 20 is an alternative embodiment to the pair shoes 50 shown in FIG. 1. Regardless whether a pair of shoes or a single shoe is connected to the machine frame 12, the shoes 50 and conveyor support frame 20 are both pivotally mounted to the frame 12 and actuated by a common set of piston cylinder assemblies to move the conveyor discharge section 16 and shoes 50 into and out of an operative position. Accordingly, when the conveyor discharge section 16 is moved in a first mode of operation of the cylinder assemblies, the shoes 50 are locked in a raised or retracted position on the frame 12 as shown in FIG. 1. Similarly, when the shoes 50 are lowered into contact with the mine floor 21 in a second mode of operation of the cylinder assemblies, the conveyor section 16 is locked to the frame 12 in a lowered position, as shown in FIG. 1 and described hereinafter in greater detail.

The service shoe assemblies 50 extend from the machine frame side walls 26 and 28 downwardly below and on opposite sides of the conveyor frame 22. The connection of the shoes 50 to the machine frame 12 is rearward of the pivotal connection of the conveyor section 16 to the machine frame 12. The service shoe assemblies 50 are lowered into contact with the mine floor 21 and the conveyor discharge section 16 is lifted upwardly by actuation in two modes of operation of double acting piston cylinder assemblies generally designated by the numeral 70 in FIGS. 1, 3, and 12 and in detail in FIGS. 14 and 15.

The mining machine body portion 12 is raised up or elevated above the ground for performing maintenance service by operation of the service shoe assemblies 50. The pair of service shoe assemblies 50 is shown on the machine frame portion 12 in FIG. 2. In an alternate embodiment a single service shoe extends the width of the conveyor discharge section 16 and is actuated by one or a pair of double acting piston cylinder assemblies in accordance with the present invention.

As shown in FIG. 1, the service shoes 50 are movable between a raised position on the machine frame 12 and a lowered positioned in contact with the mine floor 21 by operation of the piston cylinder assemblies 70. Each assembly 70 includes a cylinder end portion 78 and a telescopic end portion 80. The assembly 70 is shown in a fully retracted position in FIG. 14. Each end portion 78 and 80 has a through bore 82 for a pinned connection to the conveyor support frame 20 and service shoe 50, respectively.

Figure 10:
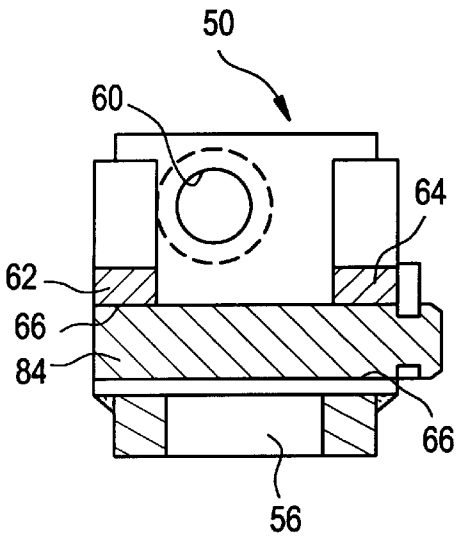
FIG. 10 is a sectional view taken along line X—X of FIG. 7, illustrating the pivotal connection of the lower end of the piston cylinder assembly to the service shoe.
Figure 12:
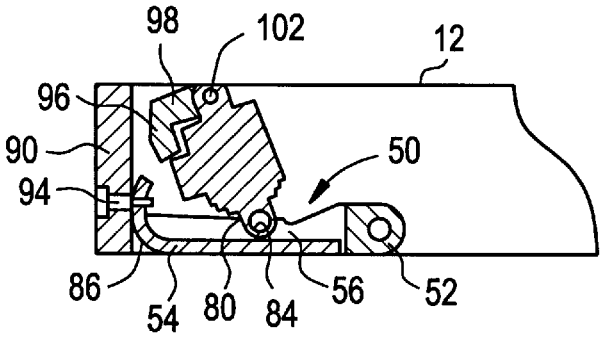
FIG. 12 is a sectional view taken along line XII—XII of FIG. 2, illustrating the connection of the conveyor discharge section and service shoe to opposite ends of one of the piston cylinder assemblies.
Figure 13:
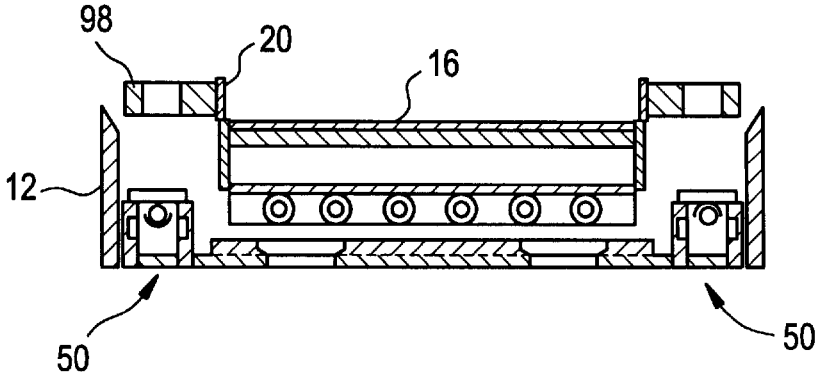
FIG. 13 is a sectional view taken along line XIII—XIII of FIG. 2, illustrating the relative position of the conveyor discharge section and the service jack assembly on the mining machine frame.

The connection of the piston cylinder assemblies 70 to the service shoes 50 is shown in FIGS. 1, 10 and 12. The telescopic portion 80 is positioned between the plates 62 and 64 (FIG. 16) of shoes 50 so that the bore 82 in the end portion 80 is aligned with the bores 66 in plates 62 and 64 to receive a pivot pin 84. The pivot pin 84 is shown in FIGS. 1, 10, and 12 in position in the bore 66 of the shoe 50. The piston cylinder assembly 70 is not shown in FIG. 10. Thus, in one mode of operation of assemblies 70 where the conveyor support frame 20 is fixed on the machine frame 12, extension and retraction of the cylinder end portions 80 move the shoes 50 into and out of contact with the mine floor 21. The extended and retracted positions of the shoes 50 are shown in FIG. 1. When the shoes 50 are in the retracted position, the ends 54 of the shoes are locked by a pinned connection to the machine frame 12, as shown in FIGS. 1, 7, and 12.

Figure 17:
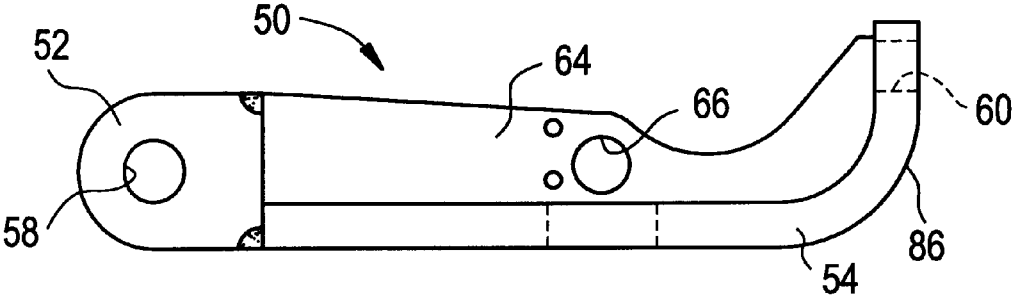
FIG. 17 is a view in side elevation of the service shoe shown in FIG. 16.

As seen in FIG. 17, the shoe ground engaging end portion 54 has an arcuate surface 86 bent through 90° and includes the bore 60. When the service shoes 50 are in a raised position, as illustrated in FIGS. 1, 7, and 12, arcuate surfaces 86 are positioned oppositely of support plates 88 and 90, as shown in FIG. 3. The support plates 88 and 90 extend transversely across the rearward end portion of the machine frame 12. The plates 88 and 90 include bores 92 aligned with the holes 60 in the ends of the shoes 50 when in the retracted or elevated position as shown in FIG. 1. To maintain the shoes 50 locked in an elevated position on the frame 12, removable pins 94 extend through the aligned bores 60 and 92.

When the shoes 50 are pinned to the machine frame 12, the piston cylinder assemblies 70 are actuated in a first mode of operation to raise the conveyor discharge section 16. With the service shoes 50 connected to the machine frame 12 and the conveyor support frame 20 released from its connection to the frame 12, extension and retraction of the cylinder end portion 80 of each cylinder assembly 70 raises and lowers the conveyor discharge section 16. In the second mode of operation of the assemblies 70, the service shoes 50 are released from their pinned connection to the machine frame 12, and the conveyor support frame 20 is locked in place in a lowered position on the machine frame 12.

Extension and retraction of the cylinder end portions 80 with the conveyor support frame 20 locked in place lowers the shoes 50 into and out of contact with the mine floor 21. Thus, the cylinder assemblies 70 serve the dual purpose of moving the conveyor section 16 and the service shoes 50. This eliminates the need for separate sets of cylinder assemblies to move the conveyor section 16 and shoes 50. Consequently, for a low seam mining machine this arrangement provides a more efficient operation of the discharge conveyor and service shoe.

The connection of the shoes 50 and the conveyor section 16 to the hydraulic assemblies 70 is illustrated in FIGS. 1 and 12. The frame 20 of the conveyor discharge section 16 includes a downwardly extending bracket 96, shown in FIG. 12, having a front end portion 98. The bracket portion 98 is permanently connected by pins 102 to the upper end portions 78 of the piston cylinder assemblies 70.

Figure 11:
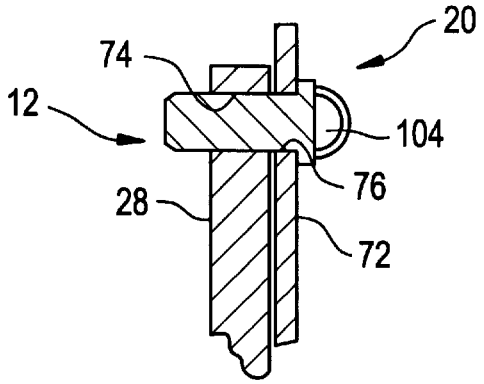
FIG. 11 is fragmentary sectional view taken along line XI—XI of FIG. 7, illustrating the pinned connection of the conveyor discharge section to the mining machine frame.

The frame 20 of the conveyor discharge section 16 is also releasably connected to the machine frame 12 by pins 104. The pinned connection of the conveyor frame 20 to the machine frame 12 is shown in FIGS. 7 and 11. As seen in FIG. 11, side walls 72 of the conveyor frame 20 are received within machine frame side walls 26 and 28 when lowered on the frame 12. The frame side walls 26 and 28 include bores 74 arranged to receive the pins 104 that pass through aligned bores 76 of conveyor frame side walls 72. This pin connection is completed within the conveyor frame 20 outwardly through the machine frame 12.

When the piston cylinder assemblies 70 are operated in a first mode to lift the conveyor discharge section 16, the pins 104 are removed from connection to the machine frame 12. The pins 94 remain in place connecting the shoes 50 to the machine frame 12, as shown in FIG. 12.

In the second mode of operation, when the service shoes 50 are used, the conveyor discharge section 16 is lowered on the frame 12, as shown in FIG. 1. The pins 104 are then reinserted in the aligned bores 74 and 76 of the machine frame 12 and the conveyor frame 20, as shown in FIG. 11. The pins 94 for the shoes 50 are then removed from the ends 54 of the shoes 50 and support plates 88 and 90. The cylinder assemblies 70 are then ready for operation in their second mode to lower the shoes 50 into contact with the mine floor.

Figure 15:
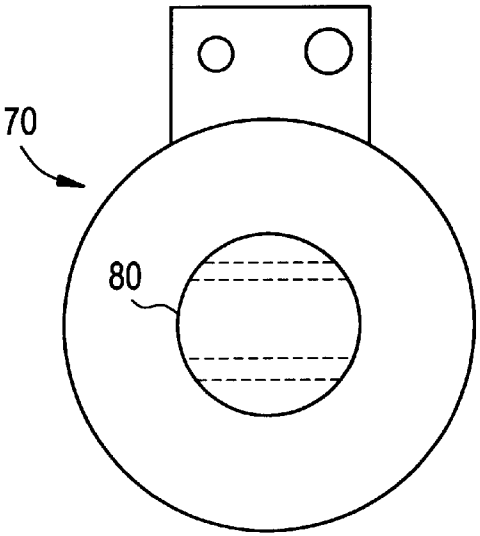
FIG. 15 is an end view of the piston cylinder assembly shown in FIG. 14.
Figure 14:
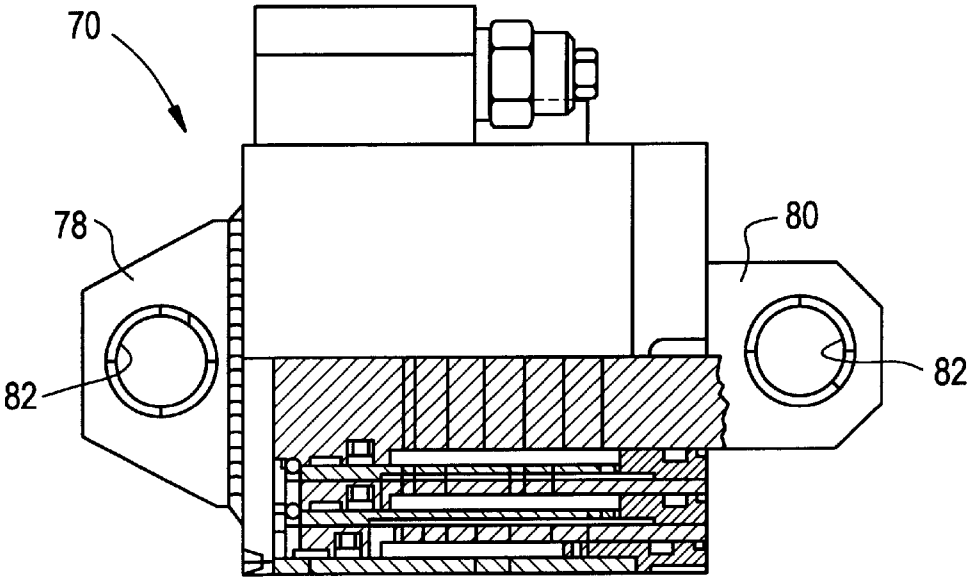
FIG. 14 is a partial sectional view in side elevation of one of the double acting piston cylinder assemblies for actuating pivotal movement of both the conveyor discharge section and service shoe on the mining machine frame.

As shown in FIG. 1 when the frame 20 of the conveyor discharge section 16 is pinned to the machine frame 12, it is in a horizontal position. Then to perform service operations on the machine 10, pins 94 are removed to allow pivotal movement of the two shoes 50 into contact with the mine floor to elevate the rear of the frame portion 12. Piston cylinders 70 are actuated in their second mode of operation to extend cylinder end portions 80 to lower the shoes 50 into contact with the mine floor 21. The lowered shoes 50 exert a sufficient downward force upon the mine floor 21 to elevate the rearward end of the frame portion 12. The assemblies 70, illustrated in detail in FIGS. 14 and 15, are conventional double acting piston cylinder assemblies operable in two modes to pivot the conveyor discharge section 16 and shoes 50 into and out of their operative positions.

Preferably, the service shoes 50 are used to elevate the mining machine frame portion 12 to permit maintenance operations to be performed, such as inspecting the tension on the crawler tracks. The service shoes 50 are also used to prop up the machine frame 12 to maneuver the mining machine 10 out of a position when it becomes immobilized due to poor mine floor conditions.

When it is desired to raise the conveyor discharge section from a horizontal position, the pins 104 are removed from the machine frame side walls 26 and 28 and the pins 94 are installed to lock the shoes 50 in an elevated position on the machine frame 12 removed from contact with the mine floor 21. Piston cylinder assemblies 70 are then actuated to lift the discharge section 16 upwardly to a desired elevation. Actuating movement of the conveyor discharge section 16 and the stabilizing jacks 50 by either one or a pair of piston cylinder assemblies 70 conserves space underneath the conveyor mechanism 14 by eliminating the need for additional piston cylinder assemblies. This also conserves the cost of installation and maintenance of piston cylinder assemblies on the mining machine 10.

Also, in accordance with the present invention the piston cylinder assemblies 70 are operable for connection to devices, other than a discharge conveyor section, required to be lifted or raised on the mining machine frame 12. Other lift devices suitable for connection to the assemblies 70 include mine roof supports, canopies, roof drilling pods, roof bolters, and any other device which is raised and lowered on the mining machine frame 12. The cylinders 70 are connected to these devices and the service shoes 50 for dual purpose operation.

According to the provisions of the patent statutes, we have explained the principle, preferred construction, and mode of operation of our invention and have illustrated and described what we now consider to represent its best embodiments. However, it should be understood, within the scope of the appended claims, the invention may be practiced otherwise than as specifically illustrated and described.

We claim:

1. A unitary lift and service shoe assembly for a mining machine comprising, a body portion having a frame, a lift portion pivotally connected to said frame for movement between raised and lowered positions, a service shoe pivotally connected to said frame for moving into engagement with the ground to raise said frame to a position elevated above the ground, a dual purpose actuator for moving said lift portion between the raised and lowered positions and moving said service shoe to elevate said frame above the ground, said dual purpose actuator having a first end portion and a second end portion, said first end portion pivotally connected to said lift portion, and said second end portion pivotally connected to said service shoe.

2. A unitary lift and service shoe as set forth in claim 1 in which, said frame includes a pair of side walls, said service shoe positioned between said side walls, said service shoe including a body portion having lateral edge portions and first and second end portions, said service shoe first end portion being pivotally connected to said side walls, and said service shoe second end portion being movable into and out of contact with the ground.

3. A unitary lift and service shoe as set forth in claim 2 in which, said service shoe second end portion includes an arcuate surface movable between a first position in contact with the ground and a second position removed from contact with the ground and positioned opposite said frame, and means for releasably connecting said shoe second end portion to said frame.

4. A unitary lift and service shoe as set forth in claim 1 in which, said actuator includes a piston cylinder assembly, said piston cylinder assembly including a cylinder having extensible end portions pivotally connected at a first end to said lift portion and at a second end to said service shoe, said lift portion movable on said frame from the lowered position to the raised position upon extension of said cylinder portion first end, and said service shoe movable on said frame into contact with the ground upon extension of said cylinder portion second end.

5. A unitary lift and service shoe as set forth in claim 1 which includes, first locking means for restraining movement of said lift portion on said frame upon actuation of said actuator to move said service shoe into engagement with the ground, and second locking means for restraining movement of said service shoe on said frame upon actuation of said actuator to move said lift portion to the raised position.

6. A unitary lift and service shoe as set forth in claim 5 in which, said first locking means includes a removable pin connection between said lift portion and said frame, and said second locking means including a removable pin connection between said service shoe and said frame.

7. A unitary lift and service shoe as set forth in claim 6 in which, said first locking means includes a pin extending through aligned bores in said lift portion and said frame where removal of said pin from said aligned bores permits pivotal movement of said lift portion on said frame to the raised position, and said second locking means includes a pin extending through aligned bores in said service shoe and said frame where removal of said pin from said aligned bores permits pivotal movement of said service shoe on said frame into engagement with the ground.

8. A unitary lift and service shoe as set forth in claim 1 in which, said lift portion includes a conveyor discharge section connected to a rearward end of said frame for vertical pivotal movement, said conveyor discharge section connected to said body frame for horizontal pivotal movement, and said service shoe being pivotally connected to said rearward end of said frame beneath said conveyor discharge section.

9. A unitary lift and service shoe as set forth in claim 8 which includes, said actuator including a double acting piston cylinder assembly extending between said conveyor discharge section and said service shoe, said piston cylinder assembly having extensible end portions, means for pivotally connecting said conveyor discharge section to one end portion of said piston cylinder assembly, and means for pivotally connecting said service shoe to an opposite end portion of said piston cylinder assembly.

10. A unitary lift and service shoe as set forth in claim 9 which includes, means for restraining pivotal movement of said service shoe on said frame upon actuation of said piston cylinder assembly to extend said one end portion to pivot said conveyor discharge section to a raised position above said frame, and means for restraining pivotal movement of said conveyor discharge section on said frame upon actuation of said piston cylinder assembly to extend said opposite end portion to pivot said service shoe into engagement with the ground to elevate said frame.

11. A unitary lift and service shoe as set forth in claim 9 in which, said piston cylinder assembly is connected at said opposite end portion to said service shoe between the point of pivotal connection of said service shoe to said frame and the point of engagement of said service shoe with the ground.

12. A unitary lift and service shoe as set forth in claim 1 in which, said lift portion includes a conveyor discharge section connected to a rearward end of said frame for vertical pivotal movement, and said service shoe pivotally connected to said frame beneath said conveyor discharge section between the point of connection of said conveyor discharge section to said frame and said rearward end thereof.

13. A unitary conveyor lift and service shoe for a mining machine comprising, a body portion having a frame, a conveyor portion pivotally connected to said frame for movement between raised and lowered positions, a service shoe pivotally connected to said frame for movement into engagement with the ground to elevate said frame above the ground, a piston cylinder assembly for moving both said conveyor portion between raised and lowered positions and said service shoe into and out of engagement with the ground, said piston cylinder assembly having a first end and a second end, said first end pivotally connected to said conveyor portion, and said second end pivotally connected to said service shoe.

14. A unitary conveyor lift and service shoe as set forth in claim 13 in which, said frame includes a pair of side walls, said service shoe being positioned adjacent to said side walls, said service shoe including a unitary body portion having a transverse dimension extending between said side walls, said unitary body portion having a first end portion pivotally connected to said side walls and a second end portion movable into and out of contact with the mine floor, and said unitary body portion connected to said piston cylinder assembly between said first and second end portions.

15. A unitary conveyor lift and service shoe as set forth in claim 14 in which, said service shoe second end portion has an arcuate surface adapted to contact the mine floor, and said service shoe second end portion having means for releasably connecting said service shoe to said frame raised out of contact with the mine floor.

16. A unitary conveyor lift and stabilizing assembly as set forth in claim 13 in which, said piston cylinder assembly includes a pair of piston cylinders with each cylinder having opposite extensible end portions, said pair of piston cylinders each connected at said opposite end portions to said conveyor portion and said service shoe, and said pair of piston cylinders being operable in a first mode to move said conveyor portion between said raised and lowered positions and in a second mode to move said service shoe into and out of engagement with the ground.

17. A method for moving a conveyor and a service shoe on a mining machine comprising the steps of, pivotally mounting a conveyor portion on a rearward end of a mining machine frame for movement between raised and lowered positions, pivotally mounting a service shoe on the rearward end of the mining machine frame for movement into an out of engagement with a mine floor, connecting a first end of a double acting hydraulic cylinder assembly to the conveyor portion, connecting a second end of the double acting hydraulic cylinder assembly to the service shoe, and actuating the double acting hydraulic cylinder assembly in a first mode to move the conveyor portion between the raised and lowered positions and in a second mode to move the service shoe into and out of the engagement with the mine floor.

18. A method as set forth in claim 17 which includes, locking the service shoe in a raised position on the mining machine frame removed from contact with the ground, actuating the hydraulic cylinder assembly in the first mode to move the conveyor portion to a raised position above the mining machine frame, locking the conveyor portion in the lowered position on the mining machine frame, and actuating the hydraulic cylinder assembly in the second mode to move the service shoe into engagement with the mine floor.

19. A method as set forth in claim 17 which includes, connecting the conveyor portion to the rearward end of the mining machine frame for upward vertical pivotal movement about a horizontal axis, connecting the service shoe below the conveyor portion on the rearward end of the mining machine frame for downward vertical pivotal movement about a horizontal axis, and extending the hydraulic cylinder assembly between the conveyor portion and the service shoe.

20. A method as set forth in claim 17 which includes, removably connecting the service shoe to the mining machine frame for operation of the hydraulic cylinder assembly in the first mode to raise and lower the conveyor portion while the service shoe is maintained out of engagement with the mine floor, and removably connecting the conveyor portion to the mining machine frame for operation of the hydraulic cylinder assembly in the second mode to move the service shoe into engagement with the mine floor while the conveyor portion is maintained in the lowered position on the mining machine frame.

* * * * *